US010170066B2

(12) United States Patent
Wang

(10) Patent No.: US 10,170,066 B2
(45) Date of Patent: Jan. 1, 2019

(54) DRIVING METHOD AND DRIVING MODULE FOR GATE SCANNING LINE AND TFT-LCD DISPLAY PANEL

(71) Applicant: Shenzhen China Star Optoelectronics Technology Co., Ltd., Shenzhen, Guangdong (CN)

(72) Inventor: Zhao Wang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 143 days.

(21) Appl. No.: 15/119,719

(22) PCT Filed: Jul. 5, 2016

(86) PCT No.: PCT/CN2016/088697

§ 371 (c)(1),
(2) Date: Aug. 17, 2016

(87) PCT Pub. No.: WO2017/190416

PCT Pub. Date: Nov. 9, 2017

(65) Prior Publication Data

US 2018/0151140 A1 May 31, 2018

(30) Foreign Application Priority Data

May 4, 2016 (CN) ..... 2016 1 0288480

(51) Int. Cl.
*G09G 3/36* (2006.01)

(52) U.S. Cl.
CPC ..... *G09G 3/3677* (2013.01); *G09G 3/36* (2013.01); *G09G 2310/0248* (2013.01); *G09G 2310/08* (2013.01); *G09G 2320/02* (2013.01)

(58) Field of Classification Search
CPC ..... G09G 3/3677; G09G 2310/0248; G09G 2310/08; G09G 2320/02; G09G 3/36
See application file for complete search history.

(56) References Cited

U.S. PATENT DOCUMENTS

2007/0159441 A1* 7/2007 Yang ..... G09G 3/3677 345/99
2013/0027363 A1 1/2013 He
2015/0236713 A1* 8/2015 Yasuda ..... H03M 3/322 341/122

FOREIGN PATENT DOCUMENTS

CN 101191924 A 6/2008
CN 201159982 Y 12/2008
(Continued)

*Primary Examiner* — Srilakshmi K Kumar
*Assistant Examiner* — Brent D Castiaux
(74) *Attorney, Agent, or Firm* — Andrew C. Cheng

(57) ABSTRACT

The present disclosure discloses a driving method and a driving system for gate scanning line and a TFT-LCD display panel, the method includes: driving the gate scanning lines line by line through the CKV waveform of variable frequency of gate driver; from the first gate scanning line to the middle line of the gate scanning line, the opening time is gradually increased; from the middle line of the gate scanning line to the N-th line of the scanning line, the opening time is gradually decreased. the scanning method using unequal time of each line of gate scanning line of each line of the present disclosure, the charging time of the middle line is the longest, the charging time is gradually decreased from the middle line to both sides, increasing the charging time of the TFT-LCD of the middle region in the display panel and optimizing the overall quality performance.

7 Claims, 4 Drawing Sheets

(56) References Cited

FOREIGN PATENT DOCUMENTS

| | | | |
|---|---|---|---|
| CN | 102568430 | A | 7/2012 |
| CN | 103745694 | A | 11/2013 |
| CN | 104021768 | A | 9/2014 |
| CN | 104361877 | A | 2/2015 |
| CN | 104361878 | A | 2/2015 |
| CN | 104718704 | A | 6/2015 |
| CN | 105139818 | A | 12/2015 |
| WO | WO2013187196 | A1 | 12/2013 |

* cited by examiner

DRIVING METHOD AND DRIVING MODULE FOR GATE SCANNING LINE AND TFT-LCD DISPLAY PANEL

BACKGROUND OF THE INVENTION

1. Field of the Disclosure

The present disclosure relates to a liquid crystal display technology field, and more particularly to a driving method and a driving module for gate scanning line and a TFT-LCD display panel.

2. Description of the Prior Art

With the resolution and the size of the LCD increasing larger, the equivalent resistance and the capacitive load on the equivalent transmission route corresponding to the TFT-LCD display panel using the thin film transistor (TFT) as the main driving method are increasing. The determination of the image quality of the LCD is affected by the middle region most, in the normal conditions, the charging time of the TFT-LCD is more adequate, the image quality is better. The middle region of the large-size liquid crystal display is not affected by the conventional gate isochronous scanning technology, it is not possible to optimize the image quality of the entire LCD by adjusting the charging state of the TFT-LCD of the middle region.

Refer to FIG. 1, the FIG. 1 is a timing diagram of driving the gate scanning line in the TFT-LCD display panel of the prior art, in the case of N lines scanning lines, all of the charging time of the line gate scanning lines are T, each opening time of the line gate scanning line is equivalent. FIG. 2 is a waveform diagram of the opening times and the number of lines of the gate scanning time in the prior art. Each opening time of the line of the gate scanning line is equivalent, so that the waveform is a vertical line.

For the same time of the opening time of each line of the gate scanning lines, the middle region of the TFT-LCD display panel will have the condition of the insufficient, affects the image quality of the TFT-LCD.

Therefore, for the above problem, it is necessary to provide a driving method for gate scanning line, a driving system and a TFT-LCD display panel.

SUMMARY OF THE DISCLOSURE

To overcome the deficiencies of the prior art, the object of the present disclosure is to provide a driving method for gate scanning line, a driving system and a TFT-LCD display panel.

To achieve the above object, the technical solution of the embodiment of the present disclosure provided is:

A driving method for a gate scanning line, the method includes:

driving the gate scanning lines line by line through a CKV waveform of a variable frequency of a gate driver;

from the first gate scanning line to the middle line of the gate scanning line, the opening time is gradually increased;

from the middle line of the gate scanning line to the N-th line of the scanning line, the opening time is gradually decreased.

As a further improvement of the present disclosure, the middle line of the gate scanning line is the N/2-th line of the gate scanning line and the N/2+1-th line of the gate scanning line, the N is even.

As a further improvement of the present disclosure, in the method, the opening times of the N-th line of the gate scanning line and the N+1-n-th line of the gate scanning line are equivalent, i.e. $T_n=T_{N+1-n}$, $1 \le n \le N$.

As a further improvement of the present disclosure, in the method:

from the first line of the gate scanning line to the middle line of the gate scanning line, the opening time is gradually increased from the minimum opening time $T_{min}$ to the maximum opening time $T_{max}$ by a predetermined magnitude;

from the middle line of the gate scanning line to the N-th line of the gate scanning line, the opening time is gradually decreased from the maximum opening time $T_{max}$ to the minimum opening time $T_{min}$ by a predetermined magnitude a.

As a further improvement of the present disclosure, the specifically manufacturing method for the CKV waveform of the variable frequency is:

generating a high frequency reference signal by the crystal oscillator;

forming the CKV waveform of the variable frequency for driving the gate scanning line by the high frequency reference signal through a varying counter and a downclocking trigger.

Correspondingly, a driving module for gate scanning line, the driving module is used to forming the CKV waveform of the variable frequency and includes an available varying and downclocking module for generating the high frequency reference signal crystal oscillator and forming the CKV waveform of the variable frequency by the high frequency reference signal by downclocking, the available varying and downclocking module includes a varying counter and a trigger.

As a further improvement of the present disclosure, the varying counter includes a given value counter and an adder and/or a subtractor.

Correspondingly, a TFT-LCD display panel, the TFT-LCD display panel includes a pixel array and a plurality of gate scanning lines, the gate scanning line is driven by the above method.

The scanning method using unequal time of each line of gate scanning line of each line of the present disclosure, the charging time of the middle line is the longest, the charging time is gradually decreased from the middle line to the both sides, increasing the charging time of the TFT-LCD of the middle region in the display panel and optimizing the overall quality performance.

DETAILED DESCRIPTION OF PREFERRED EMBODIMENTS

In order to enable persons skilled in the art to better understand the technical solution of the present disclosure, the present disclosure will now be combined with the implementation of the drawings, the present disclosure will be apparent case of technical implementation of the program, a complete description of, obviously, The described embodiments are only part of the embodiments of the present disclosure, rather than all embodiments. Based on the embodiments of the present disclosure, all other embodiments by those of ordinary skill in the creative work did not make the premise that obtained should fall within the scope of the present disclosure to protect.

Figure 3:
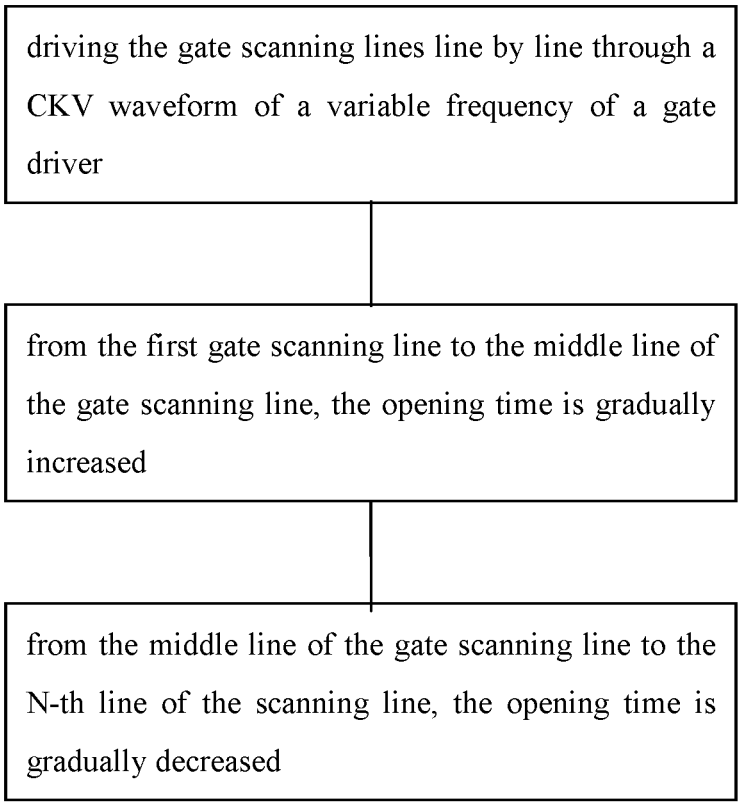
FIG. 3 is a flow diagram of the driving method for gate scanning line in a preferred embodiment of the present disclosure.

As shown in FIG. 3, in a preferred embodiment of the present disclosure, the driving method for gate scanning line includes the following steps:

driving the gate scanning lines line by line through a CKV waveform of a variable frequency of a gate driver;

from the first gate scanning line to the middle line of the gate scanning line, the opening time is gradually increased;

from the middle line of the gate scanning line to the N-th line of the scanning line, the opening time is gradually decreased.

Further, the specifically generating method for the CKV waveform of the variable frequency is:

generating a high frequency reference signal by the crystal oscillator;

forming the CKV waveform of the variable frequency for driving the gate scanning line by the high frequency reference signal through a varying counter and a downclocking trigger.

The display panel in the present embodiment includes N lines gate scanning line, the N is even, the middle line of the gate scanning line is the N/2-th line of the gate scanning line and the N/2+1-th line of the gate scanning line, driving the gate scanning lines line by line through a CKV waveform of a variable frequency of a gate driver.

Figure 4:
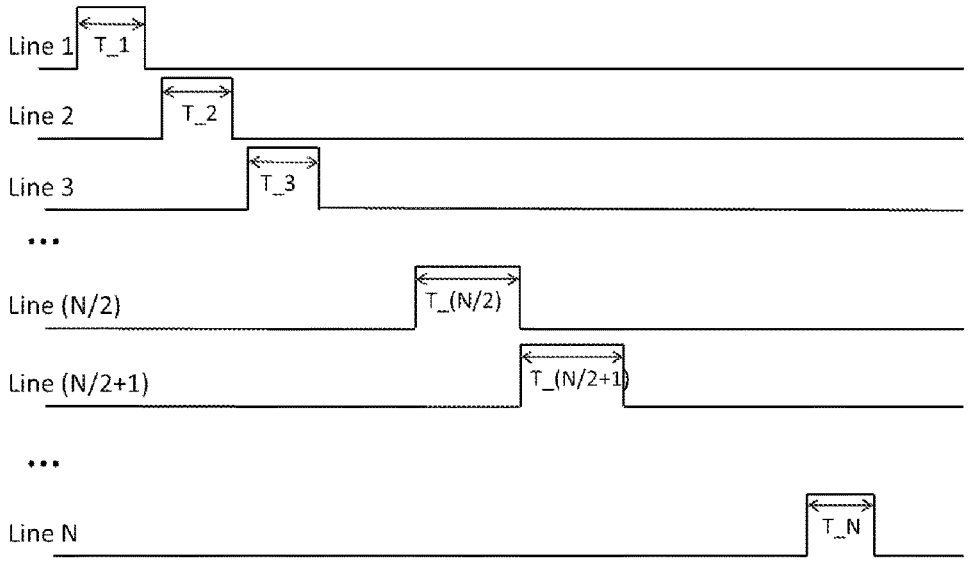
FIG. 4 is a timing diagram of driving the gate scanning line in a preferred embodiment of the present disclosure.

FIG. 4 in conjunction with FIG. 5, the driving method of the gate scanning line in the present embodiment will be described in detail.

from the first line (Line 1) of the gate scanning line to the N/2-th line (Line (N/2)) of the gate scanning line, the opening time is gradually increased from the minimum opening time $T_{min}$ to the maximum opening time $T_{max}$ by a predetermined magnitude v.

Specifically, the opening time of the first line to the N/2 line of the gate scanning lines are equal-different increasing, the amount equal to μ, $T_{min}=T1<T2<T3<\ldots T(N/2)=T_{max}$, and satisfy the following relationship:

$$T_{(N/2)}=T_{(N/2-1)}+\mu=T_{(N/2-2)}+2\mu=\ldots=T_2+(N/2-2)*\mu=T_1+(N/2-1)*\mu;$$

$$T_1=T_{min};$$

$$T_{(N/2)}=T_{max}.$$

The opening time of the N/2-th line (Line (N/2)) and the N/2+1-th line (Line (N/2)+1) gate scanning line are maximum $T_{max}$, so that the charging time of the middle line of the gate scanning line is longest, so as to optimize the image quality of the middle region of the display panel.

from the N/2+1-th line (Line N/2+1) of the gate scanning line to the N-th line (Line N) of the gate scanning line, the opening time is gradually decreased from the maximum opening time $T_{max}$ to the minimum opening time $T_{min}$ by a predetermined magnitude k.

Specifically, the opening time of the N/2+1-th line to the N-th line of the gate scanning lines are equal-different decreasing, the amount equal tot, $T_{(N/2+1)}>T_{(N/2+2)}>\ldots>T_N$, and satisfy the following relationship:

$$T_{(N/2+1)}=T_{(N/2+1)}+\mu=T_{(N/2+2)}+2\mu=\ldots=T_{(N-1)}+(N/2-2)*\mu=T_N+(N/2-1)*\mu;$$

$$T_N=T_{min};$$

$$T_{(N/2+1)}=T_{max}.$$

Specifically, the value of the t in the present embodiment is designed according to the needs, the opening time from the first line to the N/2-th line of the gate scanning line is symmetrical sequence with the opening time from the N/2+1-th line to the N-th line of gate scanning line, the opening time of the n-th line gate scanning line is equal to the opening time of the N+1−n-th line gate scanning line, i.e. $T_n=T_{N+1-n}$, $1\leq n\leq N$.

Figure 1:
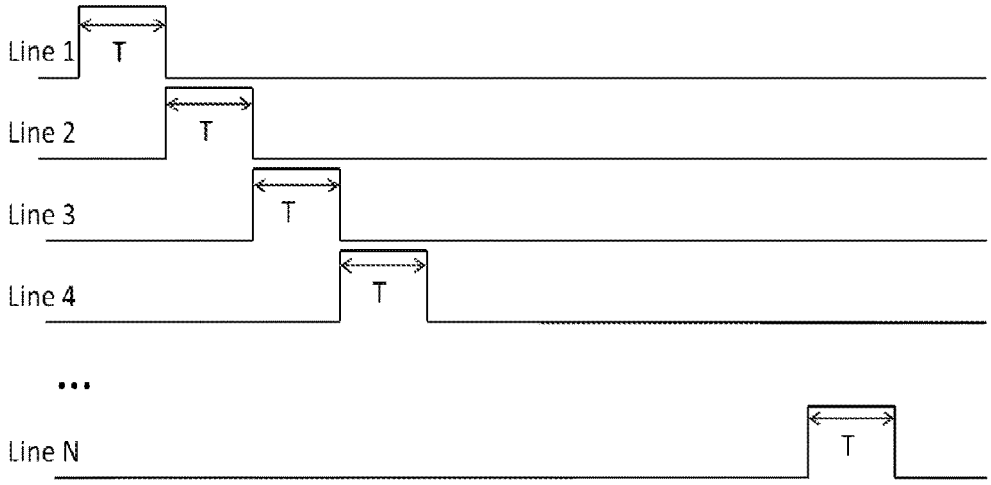
FIG. 1 is a timing diagram of driving the gate scanning line in the TFT-LCD display panel of the prior art.
Figure 2:
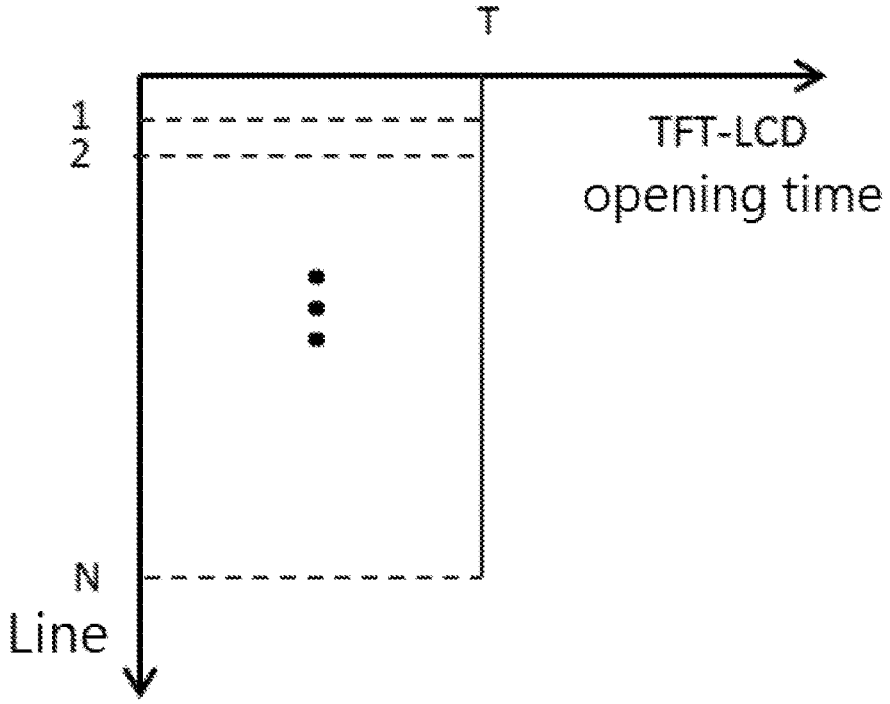
FIG. 2 is a waveform diagram of the opening time and the number of lines of the gate scanning line in the prior art.

Further, all of the opening time of the gate scanning line in the present embodiment is unchanged with the normal mode in the FIG. 1, by setting the values of the $T_{min}$, $T_{max}$ and the μ, such that $T_1+T_2+\ldots+T_N=N*T$. Of course, in other embodiment it may not be the varying average opening time in the FIG. 1, not be described in detail here.

Figure 5:
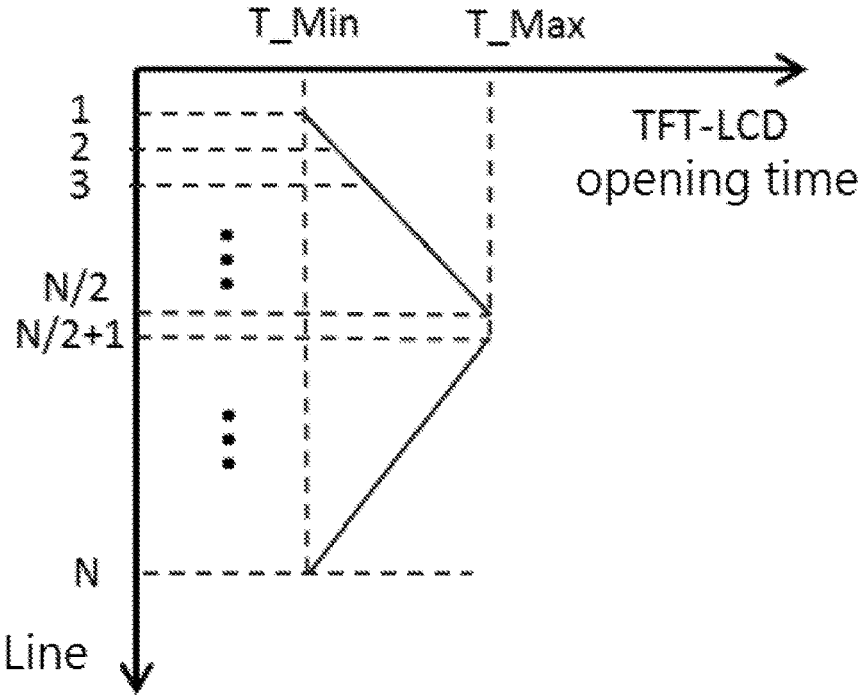
FIG. 5 is a waveform diagram of the opening time and the number of lines of the gate scanning line in a preferred embodiment of the present disclosure.

Refer to FIG. 5, FIG. 5 is a waveform diagram of the opening time and the number of lines of the gate scanning line in a preferred embodiment of the present disclosure, it can be seen the opening time of the middle region of the gate scanning line is the longest, the charging time of the middle region of the TFT-LCD is obtained an additional optimization, thereby optimizing the quality of the middle region of the TFT-LCD.

Figure 6:
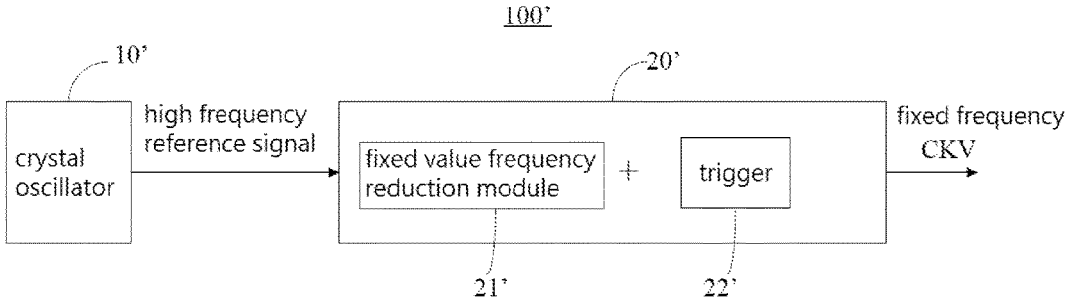
FIG. 6 is a module schematic diagram of the driving module of the gate scanning line in the prior art.

Refer to FIG. 6, FIG. 6 is a module schematic diagram of the driving module of the gate scanning line in the prior art, the CKV waveform is generated by the timing control chip (T-con IC) on the driving circuit, the driving module for gate scanning line 100' is formed by the crystal oscillator 10' and the fixed value frequency reduction module 20', the crystal oscillator 10' is used to generating the high frequency reference signal, the fixed value frequency reduction module 20' is used to frequency down the high frequency reference signal to forming a fixed frequency CKV waveform.

Wherein, the fixed value frequency reduction module 20' is composed by a given value counter 21' and a trigger 22', the high frequency reference signal generated by the crystal oscillator 10' is driven the required given value frequency signal by frequency reducing the fixed value frequency reduction module 20' to CKV. The fixed frequency of CKV is determined by the given value counter, the CKV frequency is generated 1/M of the reference frequency by the crystal oscillator.

Figure 7:
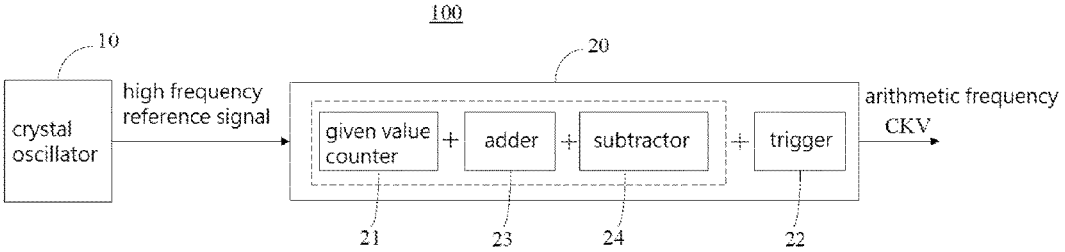
FIG. 7 is a module schematic diagram of the driving module of the gate scanning line in another embodiment of the present disclosure.

Refer to FIG. 7, FIG. 7 is a module schematic diagram of the driving module of the gate scanning line in another embodiment of the present disclosure, to achieve the variable frequency CKV waveform, redesign the fixed value frequency reduction module is required, replacing the conventional design of the given value counter to the design of "counter+adder+subtractor", the size of the CKV frequency can be controlled by the varying of the value of the counter.

Specifically, the driving module for gate scanning line 100 in the present embodiment is formed by the crystal oscillator 10 and the available varying and downclocking module 20, the crystal oscillator 10 is used to generating the high frequency reference signal, the available varying and downclocking module 20 is used to frequency reducing the high frequency reference signal to form the arithmetic frequency CKV waveform.

Wherein, the available varying and downclocking module 20 is formed by the given value counter 21, the adder 23, the subtractor 24 and the trigger 22, the high frequency reference signal generated by the crystal oscillator 10 is driven the required arithmetic frequency signal by frequency reducing the available varying and downclocking module 20 to CKV.

Specifically, when driving the first line (Line 1) gate scanning line to the N/2-th (Line (N/2)) gate scanning line, working the given value counter 21, the adder 23 and the trigger 22 in the available varying and downclocking module, gradually increasing the opening time of the gate scanning line by the operation of the adder "+1"; when driving the N/2+1-th line (Line (N/2+1)) gate scanning line to the N-th (Line N) gate scanning line, working the given value counter 21, the subtractor 24 and the trigger 22 in the available varying and downclocking module, gradually decreasing the opening time of the gate scanning line by the operation of the subtractor 24 "−1".

Another embodiment of the present disclosure further discloses a TFT-LCD display panel, the TFT-LCD display panel is identical to the conventional display panel, including a pixel array and a plurality of gate scanning line, the gate scanning line is driven by the above method in the embodiment, not repeat them in detail here.

As can be seen from the above embodiments, the scanning method using unequal time of each line of gate scanning line of each line of the present disclosure, the charging time of the middle line is the longest, the charging time is gradually decreased from the middle line to the both sides, increasing the charging time of the TFT-LCD of the middle region in the display panel and optimizing the overall quality performance.

For the skilled artisan, the present disclosure is clearly not limited to the details of an exemplary embodiment, but without departing from the spirit or essential characteristics of the present disclosure, the present disclosure can be achieved in other specific forms. Therefore, no matter from what point of view, should be seen as an exemplary embodiment, but not limiting, the scope of the present disclosure is defined by the appended claims rather than the foregoing description define, and therefore intended to fall claim All changes which come within the meaning and range of equivalents of the elements to include in the present disclosure. The claims should not be seen as the right to restrict any reference signs involved requirements.

Further, it should be understood that although the present specification are described in accordance with the embodiment, but not every embodiment contains only a separate aspect, this narrative description only for the sake of clarity, those skilled in the specification should be as a whole, in the case of the embodiments of technical solutions to be suitably combined to form other embodiments of skill in the art can understand.

What is claimed is:

1. A driving method for a plurality of gate scanning lines, wherein, the driving method comprises:

driving the gate scanning lines line by line through a CKV waveform of a variable frequency of a gate driver;

from a first line of the gate scanning lines to a middle line of the gate scanning lines, an opening time is gradually increased for each of the gate scanning lines;

from the middle line of the gate scanning lines to a N-th line of the gate scanning lines, the opening time is gradually decreased for each of the gate scanning lines, wherein the middle line of the gate scanning lines comprises a N/2-th line of the gate scanning lines and a N/2+1-th line of the gate scanning lines, the opening time of the N/2-th line of the gate scanning lines is the same as the opening time of the N/2+1-th line of the gate scanning lines, and N is an even integer.

2. The driving method according to claim 1, wherein, the opening times of the N-th line of the gate scanning lines and the N+1−n-th line of the gate scanning lines are equivalent, i.e. $T_n=T_{N+1-n}, 1\leq n\leq N$.

3. The driving method according to claim 2, wherein, from the first line of the gate scanning lines to the middle line of the gate scanning lines, the opening time is gradually increased from a minimum opening time $T_{min}$ to a maximum opening time $T_{max}$ by a predetermined magnitude μ;

from the middle line of the gate scanning lines to the N-th line of the gate scanning lines, the opening time is gradually decreased from the maximum opening time $T_{max}$ to the minimum opening time $T_{min}$ by the predetermined magnitude μ.

4. The driving method line according to claim 1, wherein, the CKV waveform of the variable frequency is generated by:

generating a high frequency reference signal by a crystal oscillator;

forming the CKV waveform of the variable frequency for driving the gate scanning lines by the high frequency reference signal through a varying counter and a downclocking trigger.

5. A driving circuit for gate scanning lines, wherein, the driving circuit is used to form a CKV waveform of a variable frequency and comprises a varying and downclocking circuit for receiving a high frequency reference signal from a crystal oscillator and forming the CKV waveform of the variable frequency by downclocking the high frequency reference signal through the varying and downclocking circuit, the varying and downclocking circuit comprises a varying counter and a trigger, wherein the driving circuit drives the gate scanning line by using the CKV waveform of the variable frequency such that, from a first line of the gate scanning lines to a middle line of the gate scanning lines, an opening time is gradually increased for each of the gate scanning lines and, from the middle line of the gate scanning lines to a N-th line of the gate scanning lines, the opening time is gradually decreased for each of the gate scanning lines, wherein the middle line of the gate scanning lines comprises a N/2-th line of the gate scanning lines and a N/2+1-th line of the gate scanning lines, the opening time of the N/2-th line of the gate scanning lines is the same as the opening time of the N/2+1-th line of the gate scanning lines, and N is an even integer.

6. The driving circuit according to claim 5, wherein, the varying counter comprises a given value counter and an adder and/or a subtractor.

7. A TFT-LCD display panel, wherein the TFT-LCD display panel comprises a pixel array and a plurality of gate scanning lines, wherein the gate scanning lines are driven by the driving method according to claim 1.

* * * * *